US011819110B2

(12) United States Patent
Kapogiannis

(10) Patent No.: US 11,819,110 B2
(45) Date of Patent: Nov. 21, 2023

(54) HAIR EXTENSION WORK PANEL

(71) Applicant: Mary Kapogiannis, Richmond Hill (CA)

(72) Inventor: Mary Kapogiannis, Richmond Hill (CA)

( * ) Notice: Subject to any disclaimer, the term of this patent is extended or adjusted under 35 U.S.C. 154(b) by 29 days.

(21) Appl. No.: 17/388,211

(22) Filed: Jul. 29, 2021

(65) Prior Publication Data

US 2022/0031048 A1 Feb. 3, 2022

Related U.S. Application Data

(60) Provisional application No. 63/059,116, filed on Jul. 30, 2020.

(51) Int. Cl.
*A41G 5/00* (2006.01)
*A45D 44/04* (2006.01)

(52) U.S. Cl.
CPC ..... *A45D 44/04* (2013.01); *A41G 5/0046* (2013.01); *A41G 5/008* (2013.01)

(58) Field of Classification Search
CPC ..... A41G 5/00; A41G 5/004; A41G 5/0046; A41G 5/0053; A41G 5/008; A41G 5/0086; A45D 7/00; A45D 2007/002; A45D 19/005; A45D 19/00; A45D 44/04; A63H 3/44
See application file for complete search history.

(56) References Cited

U.S. PATENT DOCUMENTS

| | | | | |
|---|---|---|---|---|
| 10,306,970 | B2 | 6/2019 | Calabrese | |
| 2005/0109367 | A1* | 5/2005 | Smith | A45D 44/14 132/333 |
| 2013/0104922 | A1 | 5/2013 | Hall et al. | |
| 2015/0257515 | A1 | 9/2015 | Bernard | |
| 2020/0297099 | A1* | 9/2020 | Grant | A45D 44/04 |

OTHER PUBLICATIONS

YouTube Video https://www.youtube.com/watch?v=xt_v2kQYOQk Bombay Hair How to replace tape for tape-in extension (Year: 2017).*

* cited by examiner

*Primary Examiner* — Rachel R Steitz
(74) *Attorney, Agent, or Firm* — Cherskov Playnik & Gurda, LLC

(57) ABSTRACT

The invention can be used by persons that use tape-in style hair extensions. The invention includes a flat panel with several horizontal entry points aligned in rows. Both sides of the panel are utilized. A tape-in style hair extension is fed into the panel through a horizontal entry point from one side and comes through on the other side. The hair is then fastened by the clip/fastener on the opposite side just above the horizontal entry point. Vertically, each set of horizontal entry points, coupled with a clip/fastener on the opposite side, is also spaced apart leaving room for the user to have workspace for each individual hair extension. Once the hair extension is secured by the clip/fastener, the user can then remove the old tape-tab and prepare the tape-in style hair extension for reuse by adhering a new tape tab to each extension.

12 Claims, 4 Drawing Sheets

HAIR EXTENSION WORK PANEL

This application claims priority to U.S. Provisional Filing Ser. No. 63/059,116, filed on Jul. 30, 2020, the contents of which are incorporated by reference.

FIELD

The present disclosure relates to a device and method for preparing hair extensions. More specifically, the invention relates to a work panel for working with hair extensions.

BACKGROUND

The preparation for reuse of tape-in style hair extensions is a tedious and very time-consuming process as each individual tape-in style extension must have the old tape removed from the tape-tab portion of the tape-in style hair extension using a solvent, then washing or shampooing the tape-in style hair extension, awaiting drying, and then reapplying new tape to the tape-tab portion of the hair extension. There is a need for a device and method to simplify working with tape-in style hair extensions.

SUMMARY

In the present disclosure, a device and method for easily replacing the used tape tab of a hair extension with a new tape tab are described.

Thus, by one broad aspect of the present invention, a device is provided for working with a hair extension, comprising a panel with horizontal entry points for passing a hair extension through and clips to hold the hair extension in place for working on the hair extension.

By a further broad aspect of the present invention, a method is provided for working with a hair extension, comprising passing a hair extension through a horizontal entry point of a panel, clipping the hair of the hair extension in place, and working on the hair extension.

A further understanding of the functional and advantageous aspects of the invention can be realized by reference to the following detailed description and drawings.

BRIEF DESCRIPTION OF THE DRAWINGS

Embodiments disclosed herein will be more fully understood from the following detailed description taken in connection with the accompanying drawings, which form a part of this application, and in which.

DETAILED DESCRIPTION

Figure 1:
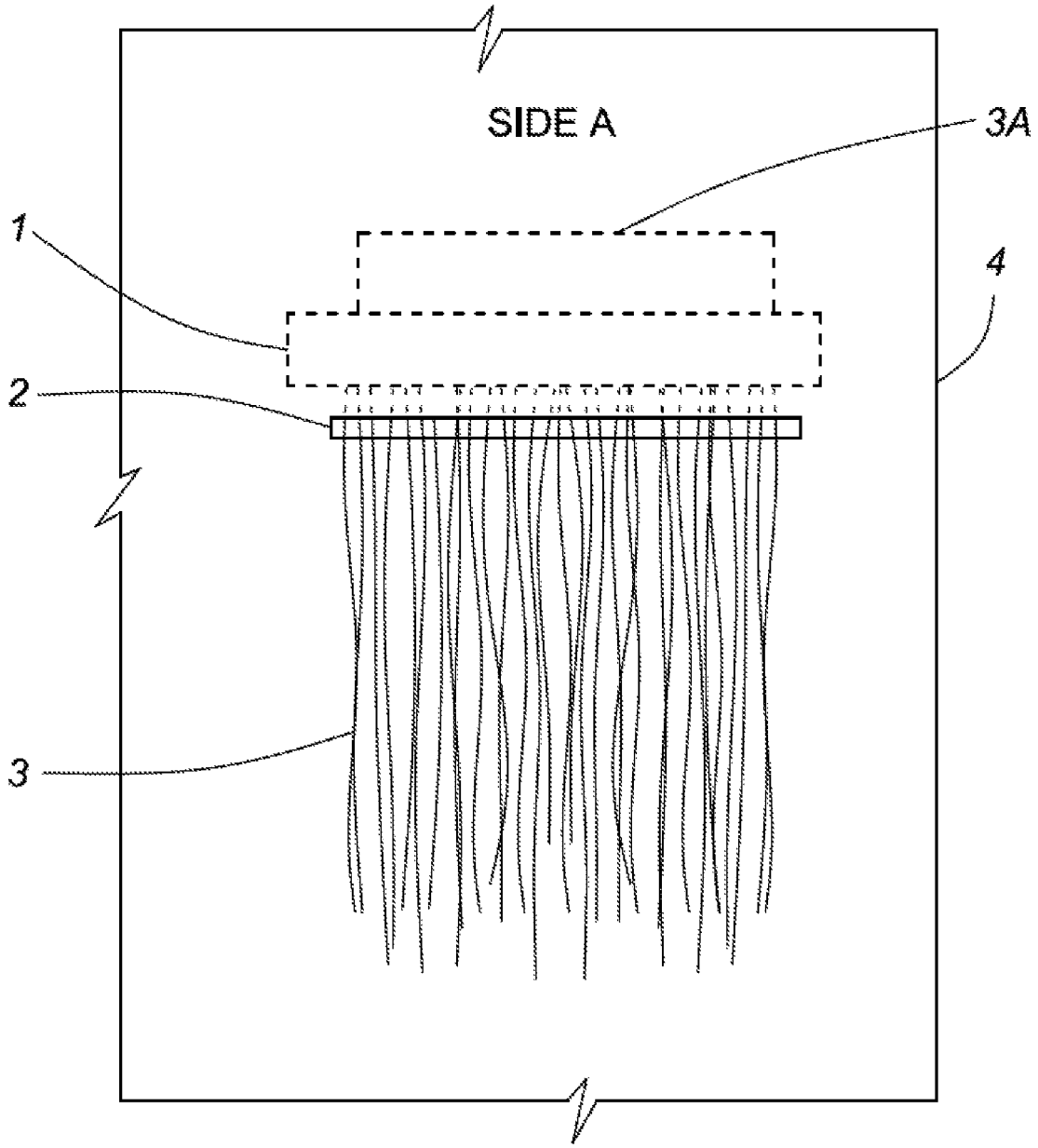
FIG. 1 is an illustration of SIDE A of a panel and a hair extension according to an embodiment of the present disclosure.

The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

The hair extension work panel (also known as the "Extension Expert") pertains generally to working with hair extensions, and more specifically, to the preparation for the reuse of tape-in style hair extensions. The panel includes horizontal cuts/holes which a Tape-In Style extension can be fed through to the opposite side of the panel in order to be fastened by a clip/fastener, roughly the same width as the horizontal cut. The panel contains several separate contact points for which an extension can slip through manually. The clip/fasteners offer steadiness for the Tape-In Style Hair Extension to be secured on the Tape-Tab portion. The user is able to connect several Tape-In Style Hair Extensions onto one panel during the removal and reapplication of the Tape-In Style Hair Extension process. The clip/fasteners provide stability as they are equipped with padding on the inside of each Clip/fastener, which prevents the creasing of the hair and prevents slipping. The space above each clip/fastener allows the user to work on the Hair Extensions.

The invention possesses several benefits and advantages for the end-user over the conventional methods of removing the old tape-tab and reapplying the new tape-tabs on the Hair Extensions:

a. The panel can be used as a receptacle for each Tape-Tab Style Hair Extension and as a mobile standalone workstation.
b. The panel can save the user time during the removal of the tape-tabs as all Hair Extensions can have their tape-tabs removed systematically.
c. Separating the components of the Hair Extension allows the user to spray the solvent/remover onto only one side, eliminating the solvent/remover contamination of the hair on SIDE A of the hair extension work panel.
d. By using this method to remove the tape from the tape-tabs, it prevents the hair from sticking to other Hair Extensions thus preventing wasted Hair Extensions.
e. The format/design of the panel can save the user time during the reapplication of the tape-tabs as the new tape can be reapplied systematically in rows (across each clip/fastener) or in a vertical format (up and down).
f. The design of the panel may save the user time during the wash/shampoo process of the Hair Extensions as the tape-tap portion, and the hair portion of the Hair Extension are separated, and all the Hair Extensions can be washed at the same time. The Hair Extensions can be combed in a downward fashion as with normal hair. This may prevent matting of the Hair Extensions.
g. The panel can be mounted vertically as it is equipped with a mounting clip/fastener at the top to dry the hair in an upright position. The mounting of the panel can allow the user to blow dry or air dry the Hair Extensions before reapplying the tape-tabs to the natural head of hair. The Hair-Extensions can also be pre-styled.
h. The panel can be used to transport the Hair Extensions to the hairstylist which can save the stylist time during reapplication as the hair can be organized by length (or in the original style/design the hairstylist had previously applied the extensions by size).
i. The panel can be used as a storage receptacle for previously used Hair-Extension pieces.

The invention pertains to a panel used as a receptacle body equipped with several horizontal cuts and clip/fasteners pertaining to the reuse of Tape-In Style Hair Extensions for which a Tape-In Style extension can be fed through to the opposite side of the panel in order to be fastened by a clip/fastener, roughly the same width.

The panel contains several separate contact points or clip/fasteners for which a Tape-In Style Hair Extension may be manually fastened. The tape-in style Hair Extensions can be fed through horizontal cuts on one side of the panel and come out on the opposite side, which has been equipped with several padded clip/fasteners mounted above the horizontal cuts to directly accept the Tape-In Style Hair Extensions.

The panel, including the clip/fasteners, may be made of any of several materials, notably polypropylene, recycled, or otherwise. The clip/fasteners can be fastened/mounted/molded onto the panel and are padded with a component (padded slip guard component) that eliminates slipping and creasing of the Tape-In Style Hair Extensions.

Another aspect of the panel provides for vertically hanging the panel onto another surface with the use of a mounting clip at the very top of the panel.

With respect to the drawings, the following table lists reference numbers and figure illustrations:

TABLE I

Figure 2:
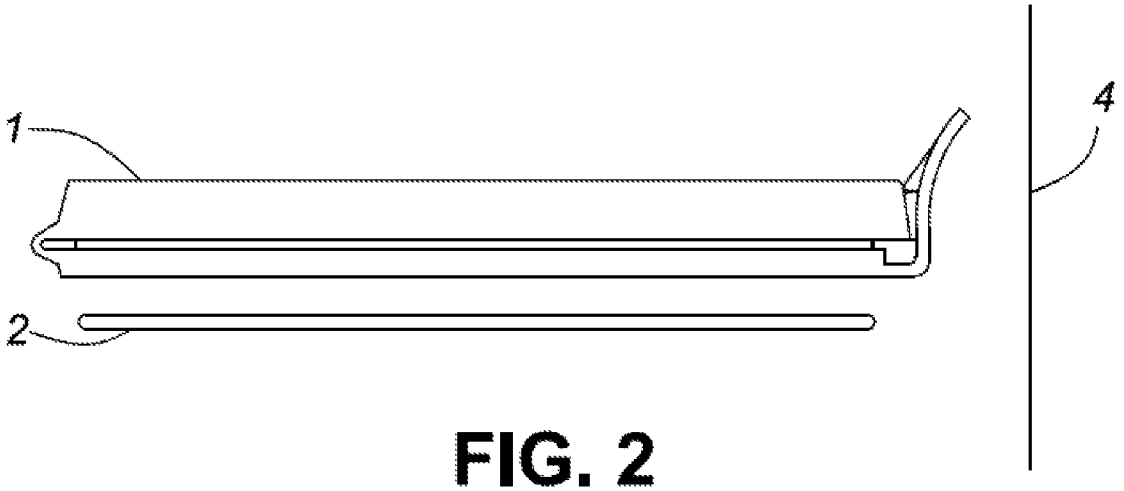
FIG. 2 is a perspective view illustrating SIDE B of a panel with a clip/fastener according to an embodiment of the present disclosure.
Figure 3:
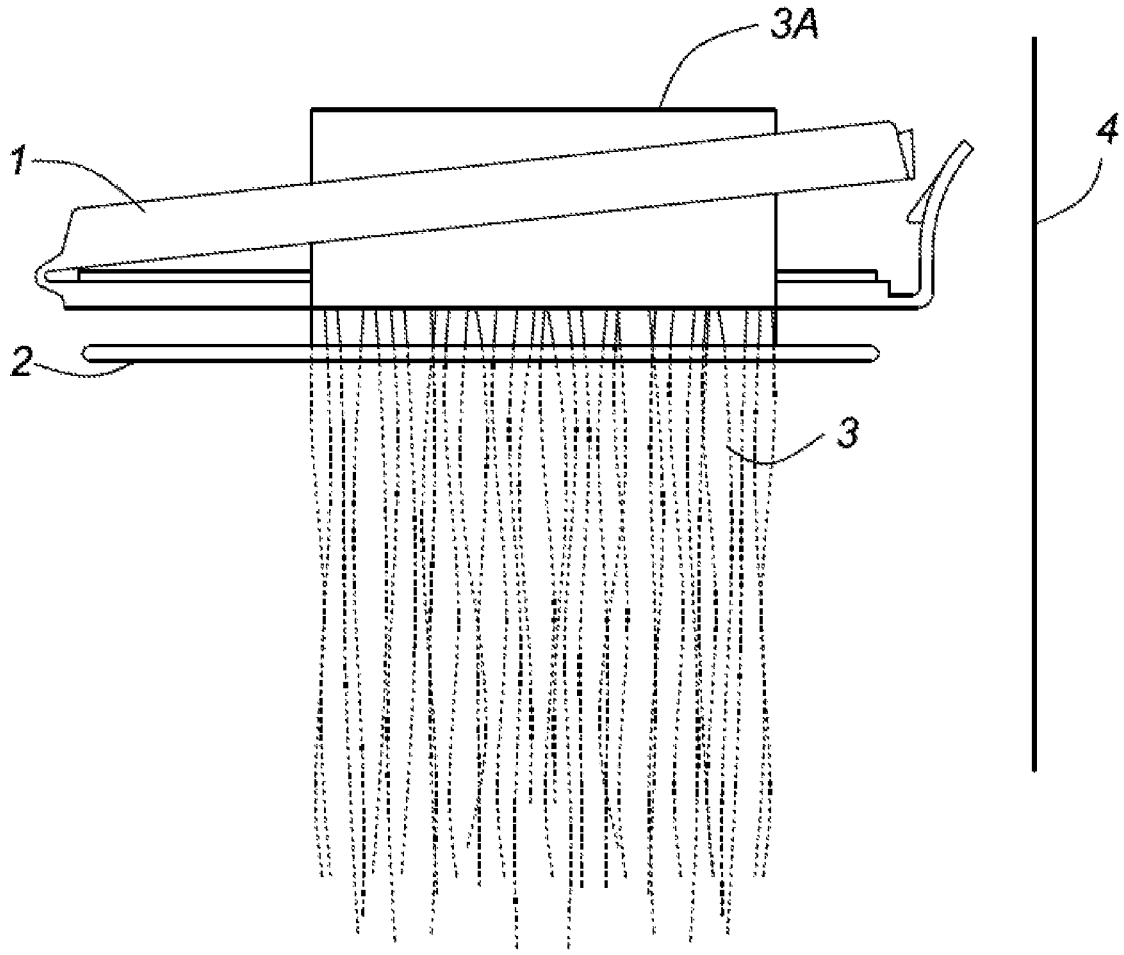
FIG. 3 is a perspective view illustrating a method of working with a hair extension using the panel shown in FIG. 2.
Figure 4:
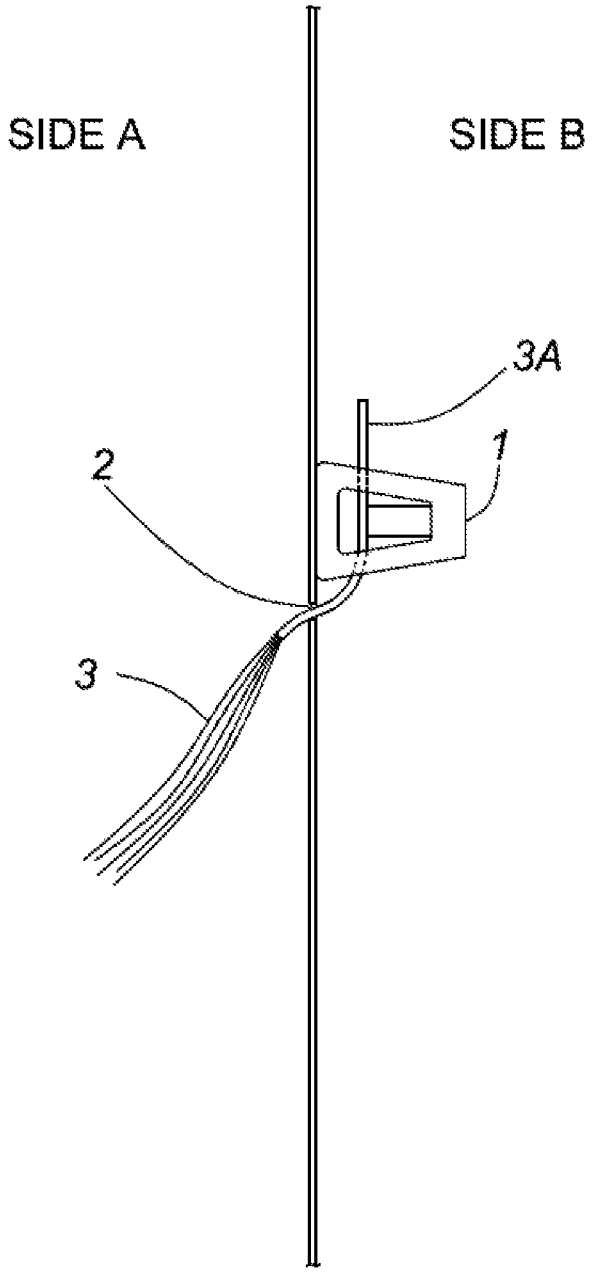
FIG. 4 is a side view of the embodiment shown in FIG. 3.

| Reference | Reference Number/Item |
|---|---|
| Side A of Panel | Panel with horizontal cuts |
| Side B of Panel | Panel where clip/fasteners and horizontal cuts reside |
| Clip/fastener | 1 |
| Horizontal Cuts going through to opposite side | 2 |
| Hair Extension with Tape-Tab | 3 |
| Tape-tab portion of Hair Extension | 3A |
| Panel Wall Right Side | 4 |
| Panel Wall Left Side | 5 |
| Panel Wall Top Side | 6 |
| Panel Wall Bottom Side | 7 |
| Mounting Clip/fastener | 8 |
| FIG. 1 | Side A of Panel with Horizontal cut 2 |
| FIG. 2 | Horizontal Clip/Fastener 1 lying flat on panel Side B, from the Panel Wall Right Side 4 as reference |
| FIG. 3 | Horizontal Clip/Fastener 1 lying flat on panel Side B with Hair Extension 3 fed through from Side A exposing tape-tab portion 3A through the clip/fastener using the Panel Wall Right Side 4 as reference |
| FIG. 4 | Horizontal Clip/Fastener 1 lying flat with Hair Extension 3 and Tape-tab portion 3A fastened into Clip/Fastener. Hair Extension Tape-tab portion 3A lying flat on panel Side B. Also visible is the Hair Extension 3 portion on Side A |
| FIG. 5 | Side B of Panel, with mounted Clip/fasteners 1 and horizontal cuts 2, through from side A. Also visible are the Right, Left, Top and Bottom Panel Wall. |

Although the invention has been described with a preferred embodiment, it should be noted that the inventor can make various modifications, additions and alterations to the invention without departing from the original scope as described in the present disclosure. The entire body and clip/fasteners are preferably made of polypropylene with the exception of the Mounting Clip As illustrated throughout the drawings, the hair extension panel comprises Side A and Side B, bordered by four sides noted as a Panel Wall Top 6, Panel Wall Left Side 5, Panel Wall Right Side 4 and Panel Wall Bottom 7.

Side B of the hair extension panel is comprised of a panel where there are a plurality of horizontal cuts 2, allowing the user to push a Tape-In style Hair Extension 3 from Side A through to Side B where the Tape-In Style Hair Extension 3 is fastened by a Clip/fastener 1 placed in proximity and directly above the horizontal cut 2, which also is approximately the same width of the clip/fastener 1. There are several horizontal cuts 2 on the panel body. The body of the panel can be made of any of several man-made materials such as plastic (polypropylene) in various thicknesses and dimensions.

FIG. 1 illustrates the Side A of the panel where only the horizontal cut 2 is visible. The Tape-tab 3A portion of a Hair Extension 3 is fed through the horizontal cut 2, face down or sticky side down, to be fed from Side A to Side B of the Panel. For the most part, when inserted correctly, only the hair should be visible on Side A. Several Tape-tab Style Hair Extensions 3 can be fed at a time, each through a different horizontal cut 2 of the panel.

As illustrated in FIG. 2, clip/fasteners 1 are adhered to the panel above each horizontal cut 2. Each Clip/fastener 1 fastened to the panel is approximately the same width as the adjacent horizontal cut 2 and sits aligned above the horizontal cut 2. The Clip/fastener 1 has two parts. Part one is the Clip/fastener component which is immobile and is adhered to the panel, and part two is the top portion which is able to lock or be released by a lock component. The clip/fasteners 1 are equipped with padding in the interior so as to provide cushioning and prevent creasing to the Hair Extension 3 when in the lock position.

The horizontal cuts 2 and clip/fasteners 1 are placed in a parallel row format staggered with respect to each other and are separated by a space between rows to allow for the Hair Extension 3 Tape-tab portion 3A to lock within each clip/fastener 1. The clip/fasteners 1 are affixed directly onto the panel and they lay flat on the panel when in the locked position.

Referring to FIG. 3, once the Hair Extension 3 is fed through SIDE A and resurfaces onto SIDE B, just below the clip/fastener 1, the Hair Extension 3 is then locked into the clip/fastener 1 by closing the clip/fastener. The Hair Extension 3 can lay semi-flat on the panel surface. The user can then spray the Tape-tab 3A portion of the Hair Extension 3 with a solvent to remove the used sticky tape-tab. The pre used tape on the Tape-tab portion 3A can be removed generally by lifting or scraping with a tool. Once all the Hair Extension Tape-Tab tapes have been removed, the user can then further clean the Tape-tab 3A portion and then adhere new Tape-tab tape to the Tape-tab 3A portion of the Hair Extension 3 while the Hair Extension 3 remains in the locked position within the clip/fastener 1.

Figure 5:
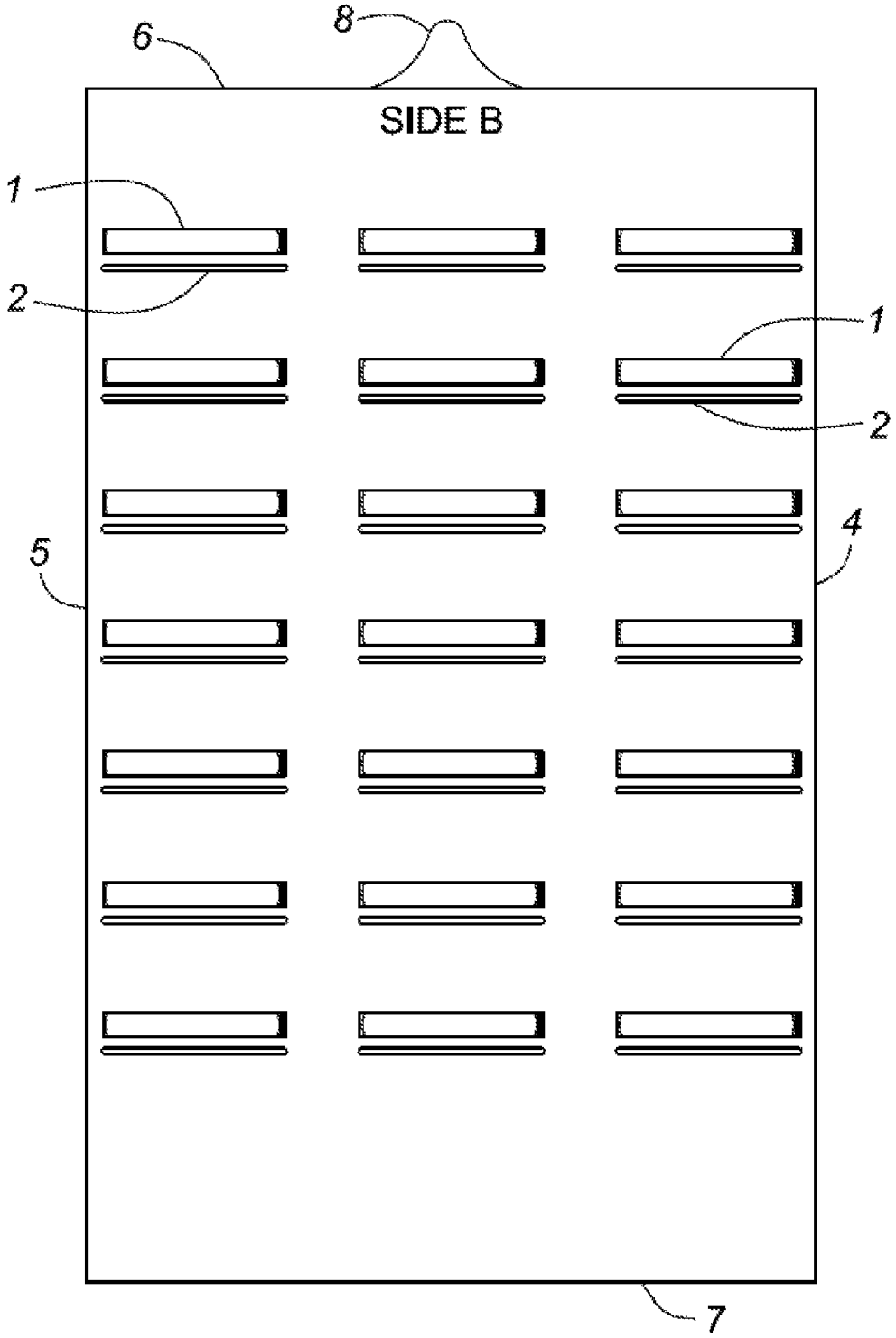
FIG. 5 is a frontal view of SIDE B of the hair extension work panel according to an embodiment of the present disclosure.

FIG. 4 illustrates a side view of a Hair Extension 3 Tape-tab style fastened into the Clip/fastener 1 as viewed from a Panel Wall Right Side as reference. On SIDE A of the panel, the hair portion of the Hair Extension 3 is visible. When all Hair Extensions 3 have been locked into place, the user can use the SIDE A to wash all the Hair Extensions 3 at the same time. Referring to FIG. 5, once the washing has been completed, the user can then use the Mounting Clip 8 to mount the panel and hang the hair to dry in an upright position. The Hair Extensions 3 can then be blow-dried and styled while in the upright position.

While the applicant's teachings described herein are in conjunction with various embodiments for illustrative purposes, it is not intended that the applicant's teachings be limited to such embodiments. On the contrary, the applicant's teachings described and illustrated herein encompass various alternatives, modifications, and equivalents, without departing from the embodiments, the general scope of which is defined in the appended claims. Except to the extent necessary or inherent in the processes themselves, no particular order to steps or stages of methods or processes described in this disclosure is intended or implied. In many cases, the order of process steps may be varied without changing the purpose, effect, or import of the methods described.

What is claimed is:

1. A method for working with hair extensions, comprising:

passing a hair extension through a horizontal entry point in a main body comprising a flat panel having a first side and a second opposing side;

removably fastening the hair extension to the flat panel with a clip adjacent to the horizontal entry point wherein said clip is located on the second opposing side of the main body flat panel than the first side from which the hair extension was passed wherein the hair extension is passed from the main body first side and said clip is located on the main body second side; and working with the fastened hair extension.

2. The method of claim 1, wherein the flat panel comprises clips to hang said flat panel in a vertical orientation for drying.

3. The method of claim 1, wherein the hair extension is a tape-in style hair extension.

4. The method of claim 1, wherein said clip located on said main body second side locks the hair extension in place.

5. The method of claim 1, wherein said working with the fastened hair extension comprises spraying the hair extension with a solvent.

6. The method of claim 1, comprising passing multiple hair extensions through multiple horizontal entry points.

7. The method of claim 6, wherein working with the fastened hair extension comprises washing the hair extension, and wherein multiple hair extensions are washed concurrently.

8. The method of claim 1, wherein said flat panel is initially in a horizontal configuration such that the hair extension is in a substantially flat configuration on the flat panel.

9. The method of claim 1, wherein said working with the fastened hair extension further comprises removing a used tape on the hair extension by agitation.

10. The method of claim 9, wherein said agitation comprises lifting and scraping with a tool.

11. The method of claim 10, further comprising adhering a new tape-tab to a tab portion of the hair extension.

12. The method of claim 1, wherein said clip comprises a horizontal main member, a pivoting point at one end of the horizontal main member, and a closure at an opposing end of the horizontal main member to removably engage the horizontal main member, allowing for secure holding of the hair extension without damaging the clip.

* * * * *